US009637848B2

(12) United States Patent
Tabibian

(10) Patent No.: US 9,637,848 B2
(45) Date of Patent: May 2, 2017

(54) BENDABLE STRAIGHT KNITTING NEEDLE WITH ERGONOMIC BENEFIT

(71) Applicant: Cyrus Tabibian, West Hills, CA (US)

(72) Inventor: Cyrus Tabibian, West Hills, CA (US)

(73) Assignee: Cyrus Tabibian, West Hills, CA (US)

( * ) Notice: Subject to any disclaimer, the term of this patent is extended or adjusted under 35 U.S.C. 154(b) by 154 days.

(21) Appl. No.: 14/599,284

(22) Filed: Jan. 16, 2015

(65) Prior Publication Data

US 2016/0208422 A1 Jul. 21, 2016

(51) Int. Cl.
*D04B 3/02* (2006.01)

(52) U.S. Cl.
CPC ..... *D04B 3/02* (2013.01)

(58) Field of Classification Search
CPC ..... D04B 3/02
USPC ..... 66/117–118, 123
See application file for complete search history.

(56) References Cited

U.S. PATENT DOCUMENTS 1,999,691 A * 4/1935 Ghaham ..... D04B 3/02 66/117
2,061,282 A * 11/1936 LeBoff ..... D04B 17/04 66/117
2,102,600 A * 12/1937 Miller ..... D04B 3/02 66/117
2,128,871 A * 8/1938 Wong ..... D04B 17/04 267/73
2,309,528 A * 1/1943 Otting ..... D04B 3/02 66/117
2,414,353 A * 1/1947 Birmingham ..... D04B 17/04 66/117
2,456,718 A * 12/1948 Marinsky ..... D04B 17/04 165/909
2,462,473 A * 2/1949 Delaney ..... D04B 3/02 66/117
2,532,409 A * 12/1950 Joho ..... D04B 17/04 66/117
2,544,429 A * 3/1951 Kadisch ..... D04B 17/04 66/117
2,586,733 A * 2/1952 Sologaistoa ..... D04B 17/04 66/117
2,633,720 A * 4/1953 Robbins ..... D04B 3/02 66/117
2,718,131 A * 9/1955 Black et al. ..... D04B 17/04 66/117
3,212,301 A * 10/1965 Sumegi ..... D04B 17/04 66/117
3,280,595 A * 10/1966 Linstead ..... D04B 3/00 66/117
4,501,133 A * 2/1985 Kretzschmar ..... D04B 3/02 66/117

(Continued)

FOREIGN PATENT DOCUMENTS

DE 4012123 A1 * 9/1990 ..... D04B 3/02
DE 4110020 A1 * 10/1992 ..... D04B 3/02
GB 407145 A * 3/1934

*Primary Examiner* — Danny Worrell

(57) ABSTRACT

A bendable straight knitting needle consisting of three parts (1,2,3) that provides ergonomic benefit by enabling bending of the needle during stitch/loop creation by the knitter typically done with two knitting needles, one in each hand. The addition of a bendable portion to the standard conventional straight knitting needle would allow flexible knitting motion with enhanced comfort and better ease of knitting in a tight space.

6 Claims, 6 Drawing Sheets

(56) References Cited

U.S. PATENT DOCUMENTS

| | | | | | |
|---|---|---|---|---|---|
| 4,553,410 | A * | 11/1985 | Okada | D04B 3/02 | 66/117 |
| 4,680,947 | A * | 7/1987 | Phipps, Sr. | D04B 3/02 | 66/117 |
| 4,693,094 | A * | 9/1987 | Kahn | D04B 3/02 | 66/117 |
| 7,954,342 | B2 * | 6/2011 | Devagnanam | D04B 3/02 | 66/117 |
| 8,181,489 | B2 * | 5/2012 | Selter | D04B 3/02 | 66/117 |
| 8,464,559 | B2 * | 6/2013 | West | D04B 3/02 | 66/117 |
| 9,181,641 | B1 * | 11/2015 | Moraca | D04B 3/02 | |

* cited by examiner

BENDABLE STRAIGHT KNITTING NEEDLE WITH ERGONOMIC BENEFIT

FIELD OF INVENTION

The present invention relates to a bendable straight knitting needle, specifically a straight knitting needle made from any material. Accordingly, a method to realize this invention is also provided.

BACKGROUND OF INVENTION

Standard straight knitting needles generally range from 10 to 16 inches, being a narrow stiff shaft that tapers at one end and has a knob at the other end to prevent stitches from slipping off Straight knitting needles are known to be made of plastic, metal, casein, or wood. These needles are used in knitting to pull loops of string through one another. Needles come in the thickness from 0.75 mm to 25 mm and are commonly marked with U.S. or U.K. sizes that correspond to the mm thickness. The long narrow stiff shaft is not bendable and can therefore result in pain, tiredness and numbness from repeated motion of writs, hands, and fingers during the formation of loops in the knitting position that must accommodate to the long straight stiff knitting shaft as well as difficulty maneuvering comfortably while knitting in confined spaces and around surrounding obstacles.

SUMMARY OF INVENTION

The present invention relates to a bendable straight knitting needle consisting of two relatively stiff shanks (1,2) one pointed at one end and one back end with internal screw threads in positioned within the back end (1) and one end is a knob and back end with internal screw threads in position within the back end (2), wherein said shanks are connected with each other by the back ends with a bendable vinyl hollow connecting tube containing a metal coil with external metal screw attached at each end of the coil (3) comprising a joint; and said joint between the stiff shanks (1,2) and the bendable hollow connecting tube (3) consisting of an external metal screw attached to the metal coil at each end and protruding out of the tube that contains the metal coil (3) to be inserted into the back end of the shank (1,2) wherein internal screw threads are positioned.

The advantage of the bendable connection is the ability to bend the needle during formation of loops in a more comfortable manner for arm, wrist, hand, and finger movements as well as more ease of knitting movement in a confined work space.

The invention also provides a method for the manufacture of the bendable knitting needle with ergonomic benefit.

DETAILED DESCRIPTION OF THE INVENTION

The present invention relates to a bendable straight knitting needle with ergonomic benefit, specifically, a long, thin, pointed rod from any material with a bendable addition which enables more natural, less labored movement of the arms, hands, wrists, and fingers during stitch formation compared to the prior art and is more accommodating to use when surrounding work space is limited. Also, the method of realizing this invention is relatively simple while maintaining the same functionality.

The bendable straight knitting needle with ergonomic benefit consists of two stiff shanks (1,2) pointed at one end (1) and one knob end (2) and suitably machined for attachment at the other ends (1,2).

Thus the product consists of two stiff shanks, one suitably pointed at one end for knitting and one with a knob at the base for holding knitted stitches, connected from the other ends using a bendable hollow vinyl tube containing a metal coil with attached metal external screws at each end of coil. The joint between the stiff shank and the bendable connecting tube consists of internal screw threads positioned inside the back end of each shank and a metal external screw connected to the metal coil that is contained in the hollow vinyl tubing. The bendable tubing will be the same thickness as the shank and extremely smooth enabling the individual stitches to slide over connection and tubing without impairment, and bendable for ergonomic benefit.

Another aspect of the invention is the method to realize this invention. The two stiff shanks of the knitting needle are made from plastic, metal, casein, or wood. The joint between the stiff shanks and the bendable tube is made by inserting the external screw which is attached to the metal coil that is contained in the bendable vinyl tube, into the stiff shank where internal screw threads are positioned and screwed and glued together.

In a preferred embodiment, the stiff shank is made of a plastic whereas the bendable connecting tube is made of bendable hollow vinyl, metal coiling, and attached external metal screw at each end of coil. In the back ends of shaft 1,2, internal screw threads are positioned and drilled.

In another embodiment of the invention, a method for the manufacture of the bendable knitting needle is provided. The shanks are manufactured by conventional manufacturing processes. The addition of the bendable material is the substance of the invention. The bendable material used is in the form of a vinyl hollow tubing that matches the thickness of the stiff shanks, metal coil with attached metal external screws. This bendable tube is connected to the stiff shanks using a protruding external screw at each end of bendable tube to be inserted and screwed into the threads of the internal screw threads which are positioned in the back ends of the stiff shanks The joint itself is made by the vinyl tubing and metal parts with attached external screw, threaded to the internal screw threads within the plastic shanks The tolerances are such that they meet the requirements of the product and the joint.

The screw is manufactured and attached to the metal coil, which is contained in the clear bendable vinyl tube.

The stiff shanks are made with the back end (the end that is not pointed or knobbed) finished to a diameter suited for development of a drilled internal screw. The external metal screw that is attached to the metal coil, which is contained in the bendable vinyl tube matches the thickness of the shank and is then inserted into the back ends of the stiff shanks.

The threaded portion of the external screw is attached directly into the internal screw threads which are positioned within the shank.

Adhesive is applied to the threaded portions to ensure that it is a permanent tight lock.

The above method results in a bendable straight knitting needle, which has the ability to bend in a manner that would be of ergonomic benefit in mobility and can accommodate more readily to a confined workspace.

DETAILED DESCRIPTION OF THE ACCOMPANYING DRAWINGS

FIG. 1 illustrates a perspective schematic view of the present invention. The two relatively stiff ends of the needle are denoted by 1,2 whereas the bendable connecting tube between the two shanks is denoted by 3. The shank is made from plastic whereas the bendable connecting tube is made from vinyl. See FIG. 1.

FIG. 4 illustrates positioning of the drilled internal screw threads (4) in the back end of each shank and the design of which shows an inward curvature that will insure a strong and even one-level closure when the connecting vinyl tube is attached. See FIG. 4.

Figure 1:
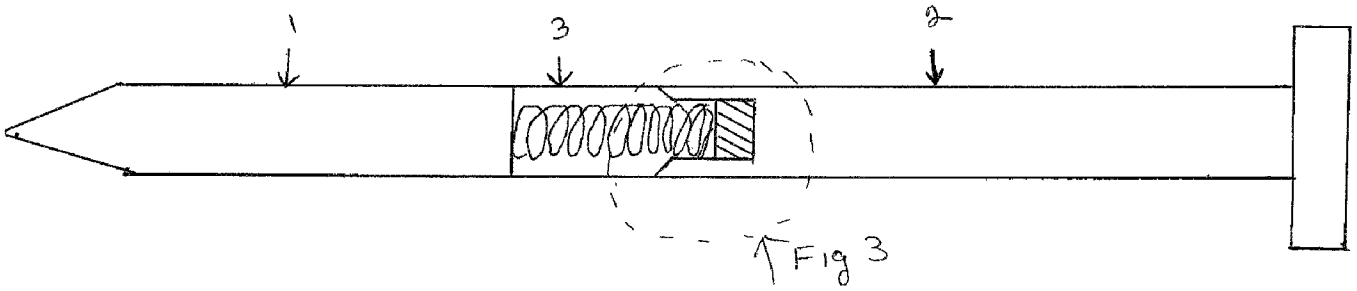
Figure 2:
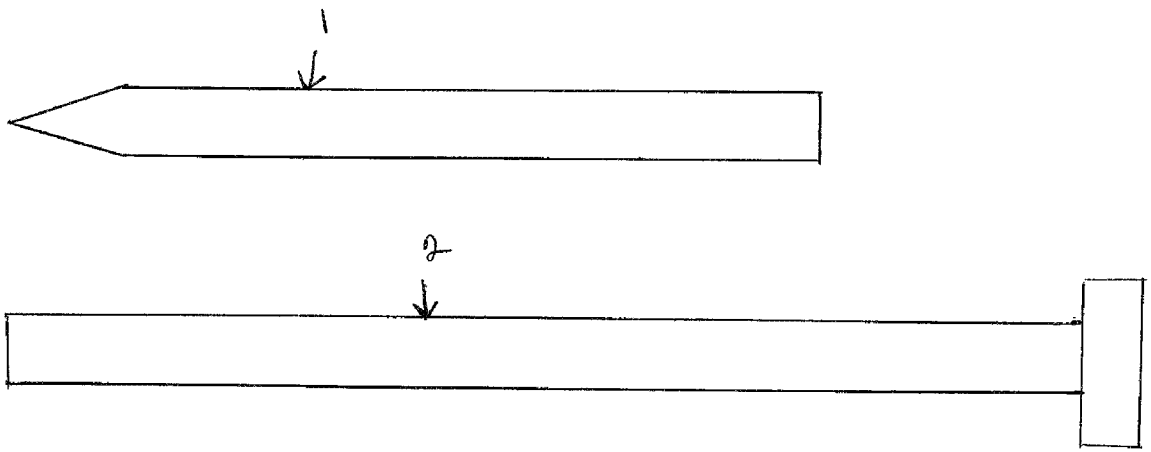
FIG. 2 illustrates one end of the needle or shank (1) which is pointed at one end and the other end forms a joint with the bendable connecting tube and one end of the knobbed shank (2) which has a knob at one end and the other end forms a joint with the bendable connecting tube. See FIG. 2.
Figure 3:
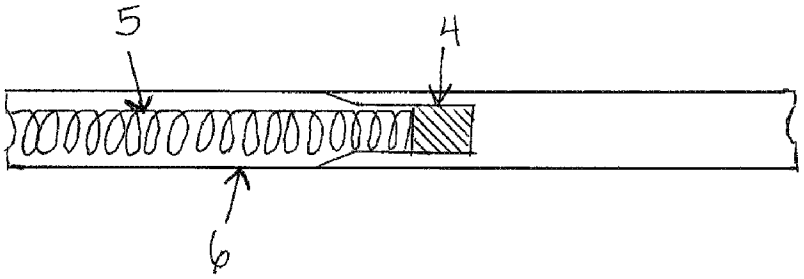
FIG. 3 illustrates the junction between the shank and the bendable connecting tube where the external screw (4) and metal coil (5) are connected, and coil contained in the vinyl tubing (6) are shown in detail. See FIG. 3
Figure 8:
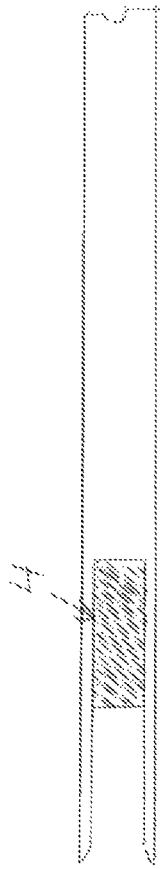
Figure 5:
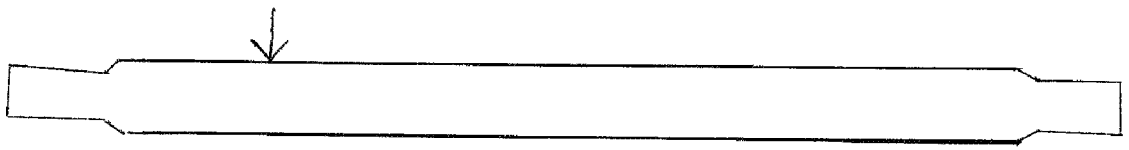

FIG. 5 illustrates the design of the bendable vinyl tubing that will connect the two stiff shafts at their back ends. A portion of the end of the vinyl tubing that contains the metal coil will also be inserted into the back end of shaft. The design shows 2 slanted edges at each end of bendable tube that will meet the opposing slanted edge of the shafts during attachment. This will insure a strong and even one-level closure when connecting. See FIG. 5.

Figure 6:
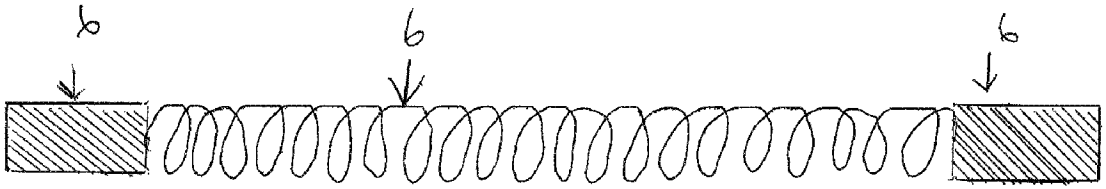

FIG. 6 illustrates the metal coil that will be contained in the vinyl tubing with the external screws attached at each end which will protrude outward from the bendable vinyl tube. See FIG. 6.

Various modifications and alterations of this invention will become apparent to those skilled in the art without departing from the scope and spirit of this invention and it should be understood that this invention is not unduly limited to the illustrative embodiment set forth herein.

The invention claimed is:

1. A bendable straight knitting needle with ergonomic benefit comprising two stiff shanks; one of the shanks having a pointed end and a back end and the other shank having a knobbed end and a back end; wherein each back end includes internal screw threads positioned within each of the back ends;

a bendable connecting portion having a thickness equal to a thickness of the needle shanks; the bendable connecting portion including a tube and a metal coil within the tube; the metal coil having two ends; each end of the metal coil having external screw threads for attachment to each back end of the two shanks; the two shanks are connected to each other by their back ends via the bendable connection portion; wherein the external screws and a portion of the tube are inside the back end of each stiff shank and the threaded portion of the external screw of the metal coil is connected to the threaded portion of the internal screw in the back end of each shank; the bendable portion of the needle providing flexibility during creation of knit loops thus relieving pressure to portions of the knitter's fingers, elbows, wrists and hands.

2. The bendable straight knitting needle of claim 1 wherein the stiff shanks are made of a material consisting of plastic, metal, casein, or wood.

3. The bendable straight knitting needle in claim 1 wherein the shank is made of plastic and the tube is made of vinyl.

4. The bendable straight knitting needle of claim 1 wherein the bendable material connecting the shanks provides relative movement between the shanks so as to allow natural mobility of hands during formation of knit loops.

5. A method of making a bendable straight knitting needle comprising the steps of: forming two stiff shanks, one of the shanks having a pointed end and a back end and the other shank having a knobbed end and a back end; finishing each back end of the shanks by adhesively bonding internal screw threads within each back end; forming a bendable connecting portion having a thickness equal to a thickness of the needle shanks; the bendable connecting portion including a tube and a metal coil within the tube; the metal coil having two ends; each end of the metal coil having external screw threads; attaching the shanks to the bendable connecting portion by screwing each end of the metal coil to the back end of the shanks so that the external screws and a portion of the tube are inside the back end of each stiff shank; the bendable portion of the needle providing flexibility during creation of knit loops thus relieving pressure to portions of the knitter's fingers, elbows, wrists and hands.

6. A method of knitting comprising:

a) providing a bendable straight knitting needle having two stiff shanks; one of the shanks having a pointed end and a back end and the other shank having a knobbed end and a back end; wherein each back end includes internal screw threads positioned within each of the back ends; a bendable connecting portion having a thickness equal to a thickness of the needle shanks; the bendable connecting portion including a tube and a metal coil within the tube; the metal coil having two ends; each end of the metal coil having external screw threads for attachment to each back end of the two shanks; the two shanks are connected to each other by their back ends via the bendable connection portion; wherein the external screws and a portion of the tube are inside the back end of each stiff shank and the threaded portion of the external screw of the metal coil is connected to the threaded portion of the internal screw in the back end of each shank;

b) forming knit loops by manipulating the two connected needle shanks while bending the bending portion and causing relative movement between the two needle shanks and between coil and tube thus minimizing and/or alleviating physical stress on the user.

* * * * *